US005145407A

United States Patent [19]

Obata et al.

[11] Patent Number: 5,145,407

[45] Date of Patent: Sep. 8, 1992

[54] MOUNTING DEVICE FOR COMPONENTS

[75] Inventors: Hiroyuki Obata; Sakae Manabe, both of Kawasaki, Japan

[73] Assignee: AMP Incorporated, Harrisburg, Pa.

[21] Appl. No.: 797,647

[22] Filed: Nov. 25, 1991

[30] Foreign Application Priority Data

Nov. 29, 1990 [JP] Japan ..... 2-125149

[51] Int. Cl.[5] ..... H01R 13/73

[52] U.S. Cl. ..... 439/567; 439/571

[58] Field of Search ..... 439/554, 557, 558, 567, 439/571, 825, 82, 751, 826, 827, 873

[56] References Cited

U.S. PATENT DOCUMENTS

| | | | |
|---|---|---|---|
| 3,048,812 | 8/1962 | Heidler | 439/825 |
| 4,186,982 | 2/1980 | Cobaugh et al. | 439/751 |
| 4,857,018 | 8/1989 | Pickles | 439/82 |
| 4,907,987 | 3/1990 | Douty et al. | 439/571 |
| 4,943,244 | 7/1990 | Teck et al. | 439/571 |
| 5,044,988 | 9/1991 | Hirayama | 439/571 |

FOREIGN PATENT DOCUMENTS

| | | |
|---|---|---|
| 1-42645 | 12/1989 | Japan . |
| 2-34774 | 9/1990 | Japan . |

*Primary Examiner*—Gary F. Paumen

*Attorney, Agent, or Firm*—Adrian J. LaRue

[57] ABSTRACT

A mounting device (30) comprises an integral stamping of sheet metal having a head portion (40) and legs (50) extending downwardly therefrom; the head portion including a latch (48) extending angularly to the plane of the sheet metal and barbs (43, 44) extending in the plane to lock within a slot (74) of a component (70), the legs (50) each including a first portion (52, 54) tapered outwardly and a second portion (**52*a*, 54*a*) tapered inwardly to provide a spring action transverse to the plane of the device and to the plane of a hole in a board in which the device is mounted. The leg portions (52*a*, 54*a***) operate to ease insertion in the hole in a board, and the ends of the said legs are free for cantilever action.

5 Claims, 2 Drawing Sheets

MOUNTING DEVICE FOR COMPONENTS

FIELD OF THE INVENTION

This invention relates to a mounting device for mounting components such as connectors or electronic modules to a printed circuit board.

BACKGROUND OF THE INVENTION

The mounting devices described in Japanese Utility Model disclosure numbers Hei 1 (1989) - 42645 and Hei 2 (1990) - 34774 represent conventional devices for mounting components such as electrical connectors, electronic modules and the like onto circuit boards. In FIG. 8, a mounting device 1 is shown positioned above a component 10 which includes a plastic housing having a projection 11 with a slot 12 therein. It is to be understood that the component 10 would have other projections, including slots adapted to receive the insertion of the mounting device 1. The device 1 includes a flat planar stamping of metal with a central aperture 3 and exterior barbs 4 along the outer edges thereof and a head portion 5. Barbs 6 extend along the outer edges of legs 7 which extend downwardly from head portion 5. The device 1 is inserted in the slot 12 with the barbs 4 biting into the opposing walls of the slot and the barbed legs 7 extending down within a hole or aperture in a printed circuit board, not shown, with respect to FIG. 8, to lock the device 1 and therefore the component 10 to the board. FIG. 9 shows an alternative version wherein a device 20 is inserted into a slot 12 of a projection 11 to lock a component to a board 28, via a hole 29 in such board. As can be seen, the device 20 is formed of flat metal stock to include a pair of ears 21 which engage on the top surface of the projection 11, a head portion 22 joining such ears, and a pair of projecting legs 24 extending down through the slot 12 and the hole 29. The legs 24 include, on the outside edge surfaces of the ends, barbs 25 which are beveled as indicated in FIG. 9 to slidingly fit through slot 12 and hole 29 and spring outwardly to catch on the undersurface of the board 28. The device 20 includes barbs 26 which bite into the walls of slot 12 and lock the device to component 10. As can be appreciated, the legs 24 are deflected inwardly to accommodate a passage of the legs through hole 29. The conventional mounting devices referred to are all flat and provide a resiliency limited to the plane of the material from which they are formed.

Accordingly, it is an object of the present invention to provide a mounting device for mounting components, such as connectors, to a printed circuit board, which exhibit an improved flexibility and have a low insertion force. It is yet a further object to provide a component mounting device which is widely tolerant of component and board dimensional variations.

SUMMARY OF THE INVENTION

The present invention achieves the foregoing objects through the provision of a one-piece, stamped and formed mounting device of thin, spring grade metal. The device features a head portion which contains barbs oriented on the edges to engage the side walls of a hole or slot in a component or electronic module and including particularly, those of electrical connectors. The head portion further includes a latch which extends, at an angle to the plane of the head and to the orientation of the barbs and which serves to lock the device within the aperture hole and component in a transverse sense.

Projecting from the head portion of the device are legs separated by a slot in the metal of the device. The legs are tapered outwardly and then inwardly to provide sloped surfaces to engage the surfaces of a hole or aperture in a board in which the device is inserted. The legs are oriented angularly to the plane of the material of the device and terminate in beveled portions, which are separated to define independent cantilever arms for the legs. In practice, the bottommost taper of the legs serves to ease insertion by engagement with the surface of the hole in which the device is inserted, and the upward leg portions serve to provide an appropriate spring action to control insertion and withdrawal forces. In accordance with the invention, the device is inserted in the hole or aperture of the component so that the legs project downwardly from the component and thereafter, the component carrying contacts or terminals may be handled and aligned with holes in a board to which the component is mounted and then inserted, the mounting devices entering appropriate apertures or holes to lock the component to the board.

IN THE DRAWINGS

DETAILED DESCRIPTION OF THE INVENTION

Figure 1:
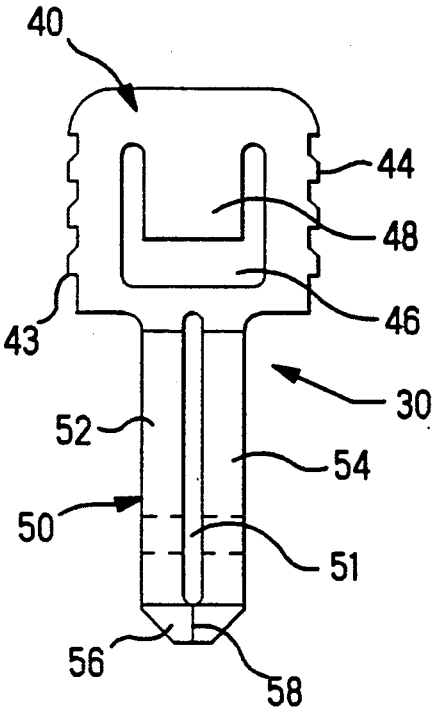
FIG. 1 is a plan view, in elevation, of the mounting device of the invention.

Referring now to FIG. 1, the component mounting device 30 may be seen to include a head portion 40 joined by legs 50 extending downwardly from the head portion. The head portion 40 includes, along the edges thereof, a series of barbs 43, 44 and a U-shaped relief 46 defining a latch 48. The latch 48 can be seen in FIG. 2 to extend outwardly, at an angle relative to the plane of the sheet material of which the device is made.

Figure 5:
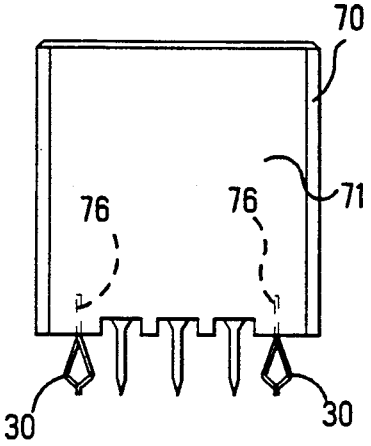
FIG. 5 is a front, elevational view showing in partial phantom the mounting of the device of the invention.
Figure 6:
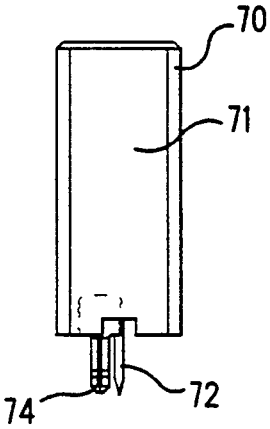
FIG. 6 is a side, elevational view of the device shown in FIG. 5.

In use, the device 30 is inserted, head first, upwardly into the base of a component. FIGS. 5 and 6 show a component 70 having a housing 71 including slots 76 in the base thereof, which are generally rectangular in cross-section. The slots 76 are dimensioned to be engaged on their opposing walls by the barbs 43 and 44 and on a shoulder of the adjacent wall by the latch 48, the sharp edges of the barbs digging into the plastic of housing 71 within the slots 76 and locking the devices 30 into position with the legs 50 thereof extending downwardly from the component base.

Figure 3:
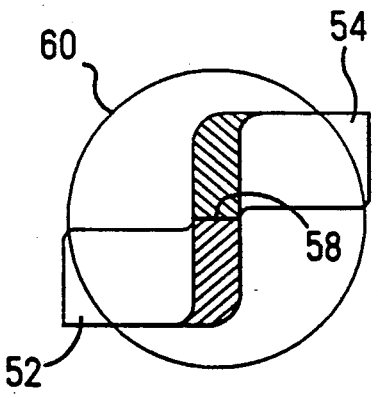
FIG. 3 is a sectional view taken through lines 3—3 of FIG. 2, showing the invention legs prior to compression relative to a hole in a board.
Figure 4:
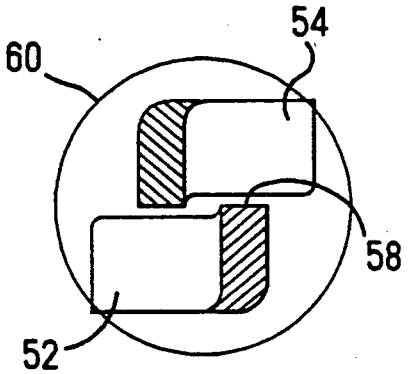
FIG. 4 is a sectional view of the legs of the invention shown in FIG. 3 following compression in a hole in a board.

Referring back to FIGS. 1 and 2, the legs 50 may be seen to include leg components 52 and 52*a* and 54 and 54*a* which terminate in a bottom end 56 and 58. Each of the legs may be seen to be beveled and bent transverse to the thickness of the sheet material of the device. The bevels 52*a* and 54*a* of the two legs operate to engage the edge of a hole 60, as shown in FIG. 3, in the manner indicated. These bevels and the rounded sections adjacent leg portions 52*a* and 52*b* ease insertion into the hole. The leg portions 52 and 54 establish a cantilever spring arm which controls the compression forces required to insert the device and thus a component into holes 60 in a printed circuit board. As can be seen in FIG. 1, the ends of the legs, such as 56 relative to leg 52, are beveled, and the legs are split as at 58 to provide a free action of the two legs in the manner shown in FIG. 4.

Figure 2:
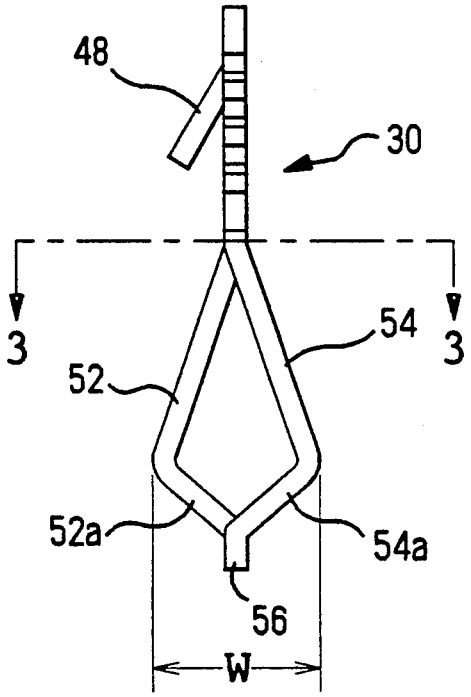
FIG. 2 is a side view of the device of FIG. 1.
Figure 7:
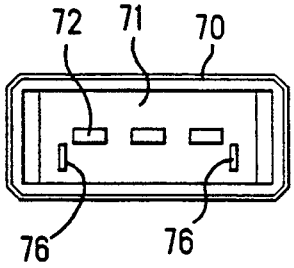
FIG. 7 is a bottom view of the component shown in FIGS. 5 and 6.
Figure 8:
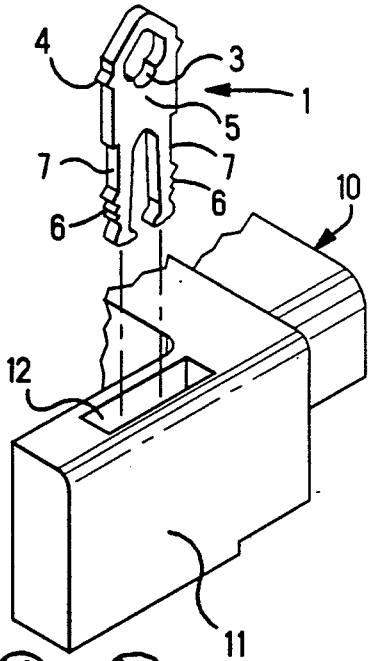
FIG. 8 PRIOR ART
FIG. 8 is a perspective showing prior art device preparatory to mounting in a component.
Figure 9:
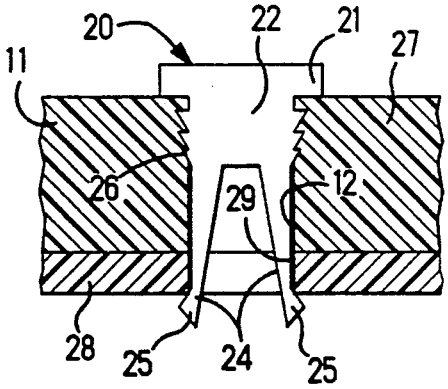
FIG. 9 PRIOR ART
FIG. 9 is an elevational and partially sectioned view showing a prior art mounting device engaged in a printed circuit board.

In a practical device, the mounting device 30 was formed of spring grade brass on the order of 0.3 mm thick and the dimension W, shown in FIG. 2, was on the order of 2.1 mm for a device made of sheet material of the appropriate thickness. Devices 30, made of harder material, will, of course, have a higher insertion force, and a change of the length of the leg portions 52 and 54 will tend to decrease the insertion force as will a change in the angle of bevel of leg portions 52*a* and 54*a*. As can be discerned from FIGS. 5–7, the mounting devices 30 may be optionally used on the sides of the component 70, to such devices as shown with component contacts 72 therebetween. These contacts may be considered to be posts, blades, tabs, or even receptacle devices, considering that the opposing contact would be of a shape to mate with such contacts.

The invention contemplates that the component 70 may be an electronic module, such as a relay or solenoid or it may be a connector adapted to interconnect solid state or other devices contained within the module to the contacts 72. The invention also contemplates the use of a mounting device in other applications wherein it is desired to fasten two elements together.

Having now described the invention in terms intended to enable a preferred practice thereof, claims are appended to define the invention.

We claim:

1. A mounting device for locking a component on a printed circuit board or the like, including a sheet metal member having a profile extending in the plane of the sheet metal member, the member including a head portion having a substantially flat section lying in said plane and having a series of barbs, said head portion fitting within a slot in the component with said barbs locking said device to said component by engaging the side walls of said slot, said member including a pair of resilient legs extending from said flat section of said head portion downwardly, separated by a slot and formed outwardly on opposite sides of said plane of the head portion to include oppositely oriented beveled portions operable to drive said legs inwardly in compression upon insertion of the legs in the hole of a board on which the component is to be mounted.

2. The device of claim 1 wherein said legs are separated at each end thereof to define a cantilever spring action upon compression of the legs.

3. The device of claim 1 wherein said oppositely oriented bevel portions serve to engage the edge surface of a hole in a board to facilitate a control of device insertion force.

4. In combination, a component such as an electrical connector or electronic module, or the like, having a plastic housing and a plurality of contacts extending from the base thereof, a plurality of slots extending into said base including interior, walls, a mounting device in each said slot, each said mounting device including a head portion having a substantially flat section lying in a plane and having barbs biting into the walls of said slot and further including operable to engage the interior walls of the respective slot by biting into the walls of said slot and further including a pair of legs extending downwardly from said housing parallel to said contacts, said legs being free at the ends thereof and beveled outwardly on opposite sides of the plane of the head portion to define cantilever springs adapted to be compressed by engagement with a hole in a board into which the device is driven to mount the component to the board.

5. The combination of claim 4 wherein said legs are of a configuration to be compressed transverse to the plane of said head portion and said bevel is adjusted to control the insertion force of the device within a hole taken in conjunction with the length of the said legs as a cantilever spring action.

* * * * *